US006851491B2

(12) United States Patent
Marshall

(10) Patent No.: US 6,851,491 B2
(45) Date of Patent: Feb. 8, 2005

(54) INTERNAL PRESSURE INDICATOR AND LOCKING MECHANISM FOR A DOWNHOLE TOOL

(75) Inventor: Gregory Marshall, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 39 days.

(21) Appl. No.: 10/259,218

(22) Filed: Sep. 27, 2002

(65) Prior Publication Data

US 2004/0060710 A1 Apr. 1, 2004

(51) Int. Cl.[7] ..... E21B 23/08
(52) U.S. Cl. ..... 175/267; 175/284; 166/381
(58) Field of Search ..... 175/267, 268, 175/269, 272, 273, 284; 166/301, 373, 55.6, 55.8

(56) References Cited

U.S. PATENT DOCUMENTS

| | | | | | |
|---|---|---|---|---|---|
| 3,949,820 A | * | 4/1976 | Furse | ..... | 175/286 |
| 4,589,504 A | * | 5/1986 | Simpson | ..... | 175/267 |
| 4,614,242 A | * | 9/1986 | Rives | ..... | 175/269 |
| 4,842,082 A | * | 6/1989 | Springer | ..... | 175/279 |
| 4,889,197 A | * | 12/1989 | Boe | ..... | 175/267 |
| 5,066,060 A | * | 11/1991 | Cooksey et al. | ..... | 294/86.18 |
| 5,201,817 A | * | 4/1993 | Hailey | ..... | 175/269 |
| 5,896,940 A | * | 4/1999 | Pietrobelli et al. | ..... | 175/269 |

FOREIGN PATENT DOCUMENTS

| | | |
|---|---|---|
| EP | 0 409 446 A1 | 1/1991 |
| EP | 0 681 088 A3 | 2/1998 |
| GB | 2 295 631 | 6/1998 |
| GB | 2 348 656 | 10/2000 |

OTHER PUBLICATIONS

U.K. Search Report, Application No. GB 0322614.9, dated Jan. 19, 2004.

* cited by examiner

*Primary Examiner*—Frank Tsay
(74) *Attorney, Agent, or Firm*—Moser, Patterson & Sheridan, L.L.P.

(57) ABSTRACT

The present invention generally relates to downhole tools. More particularly, the invention relates to a locking mechanism for use on a downhole tool. A flow actuated locking mechanism is provided for a downhole tool that includes an annular, two-position sleeve having an unlocked position and a locked position. A pin assembly within the tool is used to retain the sleeve in the locked position. In one aspect of the invention, the locking mechanism is used on a reaming tool with extendable cutters that are extendable from the body of the tool to increase the diameter of the tool and aid in forming a wellbore therearound. The locking mechanism prevents the cutters from collapsing or closing as the reamer is moved axially in the wellbore.

16 Claims, 8 Drawing Sheets

INTERNAL PRESSURE INDICATOR AND LOCKING MECHANISM FOR A DOWNHOLE TOOL

BACKGROUND OF THE INVENTION

1. Field of the Invention

The present invention generally relates to an apparatus and methods for drilling, completion and rework of wells. More particularly, the invention relates to an apparatus and method for activating and releasing downhole tools. More particularly still, the invention provides an internal pressure indicator and locking mechanism for the downhole tool.

2. Description of the Related Art

In the drilling of oil and gas wells, a wellbore is formed using a drill bit that is urged downwardly at a lower end of a tubular string. After drilling to a predetermined depth, the tubular string and bit are removed, and the wellbore is lined with a string of steel pipe called casing. The casing provides support to the wellbore and facilitates the isolation of certain areas of the wellbore adjacent to hydrocarbon bearing formations. The casing typically extends down the wellbore from the surface of the well to a designated depth. An annular area is thus defined between the outside of the casing and the earth formation. During the completion process, this annular area is filled with cement to permanently set the casing in the wellbore and to facilitate the isolation of production zones and fluids at different depths within the wellbore.

Various downhole tools are used throughout the well completion process. One such downhole tool is a conventional under-reamer. Generally, the conventional under-reamer is used to enlarge the diameter of wellbore by cutting away a portion of the inner diameter of the existing wellbore. A conventional under-reamer is typically run downhole on a tubing string to a predetermined location with the under-reamer blades in a closed position. Subsequently, fluid is pumped into the conventional under-reamer and the blades extend outward to contact the surrounding wellbore. Thereafter, the blades are rotated through hydraulic means and the front blades enlarge the diameter of the existing wellbore as the conventional under-reamer is urged further into the wellbore.

The conventional under-reamer may also be used in a back-reaming operation. In the same manner as the under-reaming operation, fluid is pumped into the under-reamer and the blades are extended outward into contact with the surrounding wellbore. Thereafter, the blades are rotated through hydraulic means and the back blades enlarge the diameter of the existing wellbore as the under-reamer is pulled toward the surface of the wellbore. However, if the blades are not securely locked in place, the upward pulling of the under-reamer causes the blades to fluctuate between an inward and outward position, thereby creating an uneven hole.

A blade locking mechanism on a conventional under-reamer includes a mandrel with a taper. The mandrel is moved between a first and a second position by a spring. Typically, the mandrel uses the mechanical advantage of the taper to apply a force on a piston to keep the blades in the fully open position. The amount of taper on the mandrel is critical to reduce the coefficient of friction at the mandrel and blade interface. For example, if the taper on the mandrel is too small, the spring will be unable to pull the mandrel from the second position to the first position, thereby causing the conventional under-reamer to become immobilized downhole. On the other hand, if the taper is too large, the mechanical advantage of the mandrel is diminished, thereby reducing the force on the piston. In either case, due to downhole conditions, the coefficient of friction on moving parts can vary greatly, making this method of locking the blades open very unpredictable.

Typically, fluid pumped through the conventional under-reamer is used to move the mandrel from the first position to the second position. In the second position, the mandrel acts against the cam mechanism to open the blades. As the mandrel slides on a body of the conventional under-reamer toward the second position, a plurality of bypass holes are exposed in the body allowing some fluid to flow out of the conventional under-reamer resulting in a lower pressure in the conventional under-reamer. This lower pressure is used as an indicator to the operator that the blades are open because the mandrel is in the second position. There are several problems associated with the use of bypass holes as an indicator. One problem relates to the less positive indication. In this method, the bypass holes are exposed as the mandrel travels on the body, which may cause time flutter and throttling at low flow rates. Another problem is that this method permits a less accurate indication of the exact position of the blades during actuation of the conventional under-reamer.

There is a need therefore, for an under-reamer that includes a positive lock mechanism to ensure the blades remain open during a back reaming operation. There is a further need therefore, for an under-reamer that includes a locking mechanism that is predictable. There is a further need for an under-reamer that includes an indicator that permits an accurate indication of the exact position of the blades during actuation of the under-reamer.

SUMMARY OF THE INVENTION

The present invention generally relates to downhole tools. More particularly, the invention relates to a locking mechanism for use on a downhole tool. A flow actuated locking mechanism is provided for a downhole tool that includes an annular, two-position sleeve having an unlocked position and a locked position. A pin assembly within the tool is used to retain the sleeve in the locked position. In one aspect of the invention, the locking mechanism is used on a reaming tool with extendable cutters that are extendable from the body of the tool to increase the diameter of the tool and aid in forming a wellbore therearound. The locking mechanism prevents the cutters from collapsing or closing as the reamer is moved axially in the wellbore. In another aspect of the invention, a signal to the surface of the well is producible based upon the position of the locking mechanism. In one embodiment, a central bore of the tool is restricted when the mechanism is in an unlocked position and is less restricted when the mechanism is in the locked position. Utilizing this variable restriction, an operator at the surface of the well can determine, based upon back-pressure, the position of the tool in the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
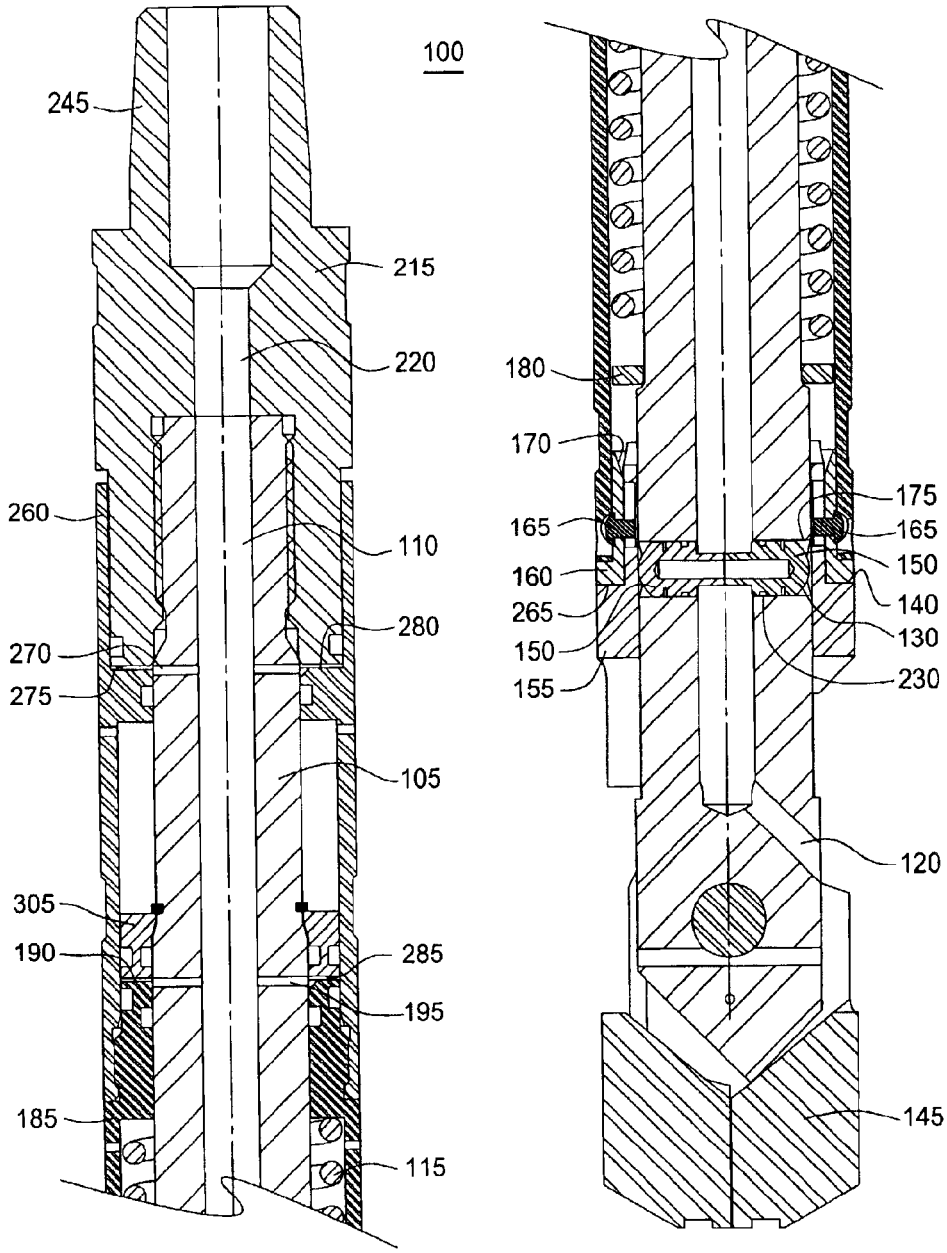
FIG. 1 is a cross-sectional view illustrating a tool in a run-in position.

FIG. 1 is a cross-sectional view illustrating a tool 100 in a run-in position. As shown, the tool 100 is an under-reamer. Generally, the under-reamer is used to enlarge the diameter of an existing wellbore by cutting away a portion of the inner diameter. It should be noted that the invention is not limited to an under-reamer, but may be employed with other downhole tools that require a positive locking mechanism and a flow indicator.

As illustrated in FIG. 1, the tool 100 includes a sub 215 at the upper end. The sub 215 is used to connect to a string of tubulars (not shown) at a connection 245. The sub 215 also includes a sub bore 220 to allow fluid communication through sub 215. As shown, the sub 215 is connected to a body 105. The body 105 includes a center bore 110 that is fluidly connected with the sub bore 220 to allow the fluid entering the tool 100 to exit out ports 120.

A housing 260 is disposed around the body 105 and the sub 215. The housing 260 is moveable between a first position and a second position by fluid pressure. As depicted, a port 270 in the body 105 is in fluid communication with a cavity 275 formed between the sub 215 and a housing surface 280. As fluid flows through the tool 100, a portion of fluid in the center bore 110 is communicated through the port 270 into the cavity 275. As more fluid enters the cavity 275, the pressurized fluid acts against the housing surface 280 to urge the housing 260 from the first position to the second position.

As illustrated on FIG. 1, a piston 185 is disposed around the body 105 and connected to the housing 260. The piston 185 is movable between a first position and a second position. As shown, a port 195 in the body 105 is in fluid communication with a cavity 285 formed between a ring 305 and a piston surface 190. As fluid flows through the tool 100, a portion of fluid from the center bore 110 is communicated through the port 195 into the cavity 285. As more fluid enters the cavity 285, the pressurized fluid acts against the piston surface 190 to urge the piston 185 from the first position to the second position. At that time, the force against the piston surface 190 overcomes an opposite force created by biasing member 115, thereafter the piston 185 moves axially downward toward the second position compressing the biasing member 115 against a stop 180.

The lower end of the piston 185 is connected to an unlocking sleeve 160 by connection pins 165. The unlocking sleeve 185 includes a taper 170 at an upper end and a sleeve shoulder 265 at a lower end. The sleeve shoulder 265 is constructed and arranged to mate with a cam shoulder 140 on cam 155. The cam 155 is arranged to shift blades 145 from the closed position to the open position upon activation of the tool 100.

As further illustrated in FIG. 1, a plurality of locking pins 150 are disposed in a plurality of side bores 175. The locking pins 150 are movable between an open and a closed position. In the closed position, as shown in FIG. 1, the locking pins 150 restrict the flow of fluid through the center bore 110 resulting in a higher pressure in the tool 100. Each locking pin 150 includes an O-ring 230 disposed around the lower portion of the locking pin 150 to create a fluid tight seal between the locking pin 150 and the side bore 175.

Figure 2A:
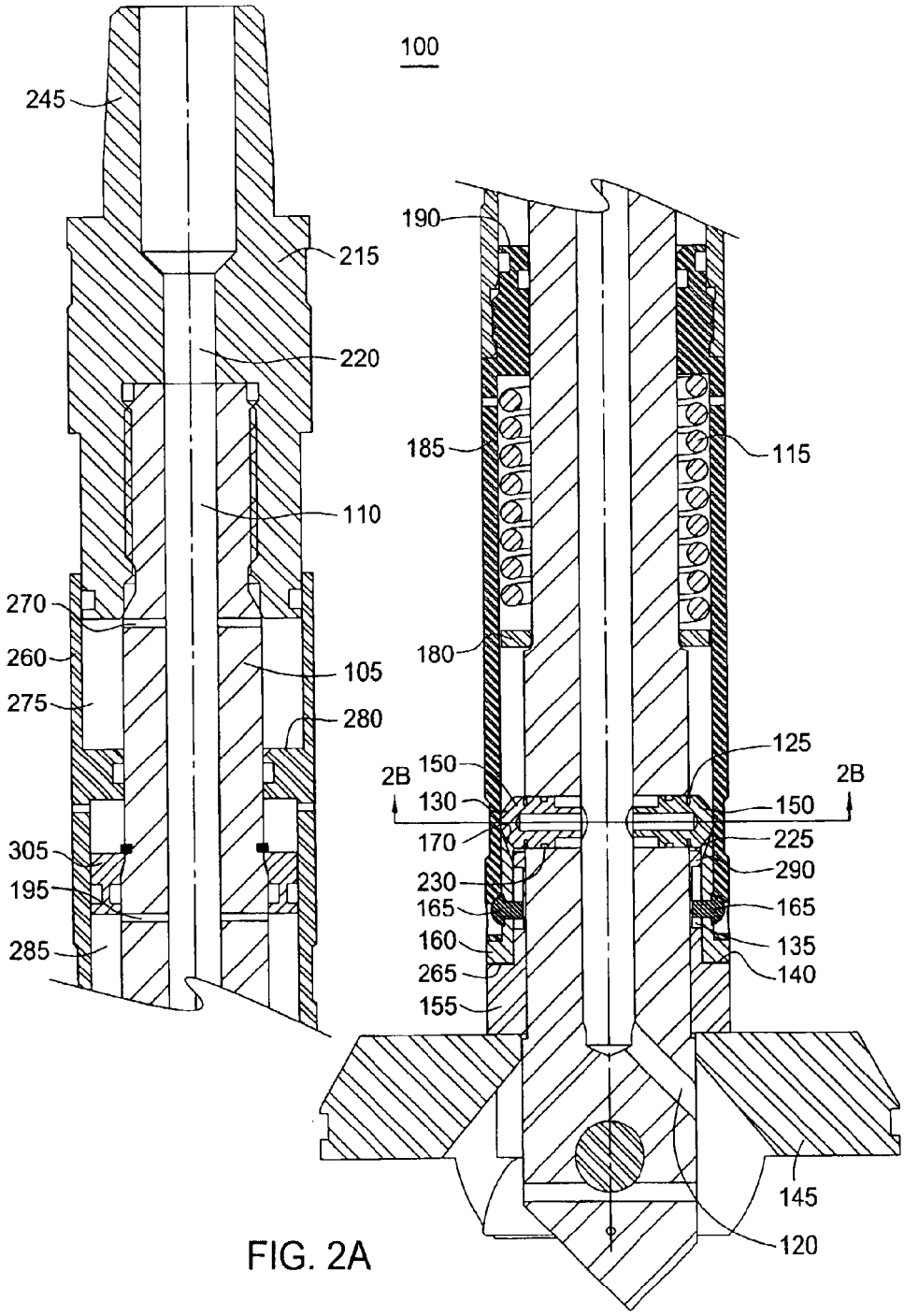
FIG. 2A is a cross-sectional view illustrating the tool blades in the open position.

FIG. 2A is a cross-sectional view illustrating the blades 145 in the open position. The fluid pumped down a tubular string (not shown) through the sub bore 270 enters the center bore 110. Thereafter, the fluid in the center bore 110 is communicated to ports 270, 195 and subsequently into cavities 275, 285. The fluid pressure in the cavities 275, 285 urge the housing 260, the unlocking sleeve 160 and the piston 185 from the first position to the second position, thereby compressing biasing member 115 against stop 180. At the same time, the sleeve shoulder 265 acts against the cam shoulder 140 to extend the blades 145 to the open position.

Additionally, the fluid pumped through the center bore 110 urges the locking pins 150 radially outward towards the open position. In the open position, an upper portion 130 of the locking pins 150 project out from the body 105, thereby exposing a pin shoulder 225. The pin shoulder 225 interacts with a cam surface 290 to prevent axial movement of the cam 155. In this respect, the locking pins 150 act as a lock to ensure the cam 155 will not move axially, thereby allowing the blades 145 to remain open throughout the operation of the tool 100.

Figure 2B:
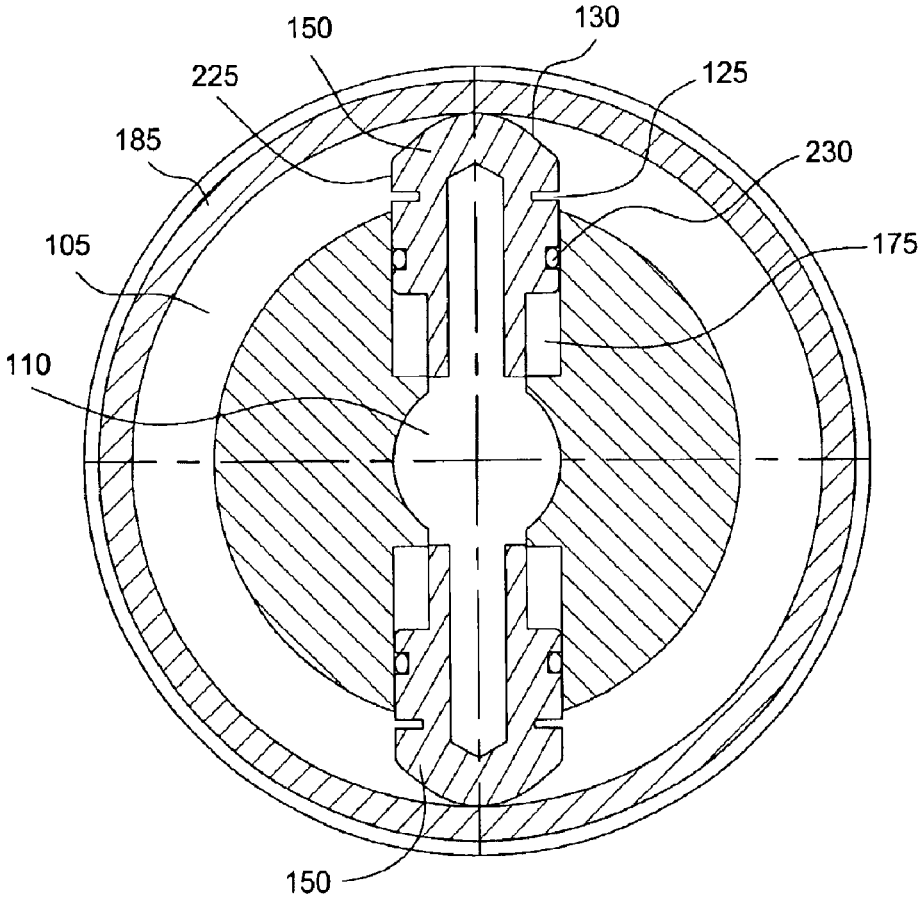
FIG. 2B is a cross-sectional view illustrating locking pins in an open position.

FIG. 2B is a cross-sectional view illustrating locking pins 150 in the open position. As shown, the locking pins 150 have moved radially outward away from the center bore 110. In the open position, the locking pins 150 no longer restrict the flow through the center bore 110 resulting in a lower pressure in the tool 100. The lower pressure corresponds to a predetermined pressure, which indicates to the operator that the blades 145 are fully extended to the open position. Conversely, the locking pins 150 in the closed position restricts the flow through the central bore 110 creating a higher pressure in the tool 100 to indicate to the operator that the blades are in the closed position. In this respect, the locking pins 150 act as an indicator to inform the operator whether the blades 145 are in the open position or in the closed position.

As clearly shown on FIG. 2B, the locking pins 150 include a shear groove 125 at the upper portion 130. The shear groove 125 is constructed and arranged to allow the upper portion 130 of the locking pins 150 to shear off at a predetermined force. Generally, if the tool 100 becomes immobilized downhole because the biasing member (not shown) or the unlocking sleeve (not shown) fails to function properly, the tool 100 may be removed by axially pulling up on the tool 100 and shearing the top portion of the locking pins 150. In this respect, the shear groove 125 acts as a back-up means to remove the locking pins 150 from contact with the cam 155 and allow the tool 100 to be removed if the tool 100 fails to function properly.

Figure 3:
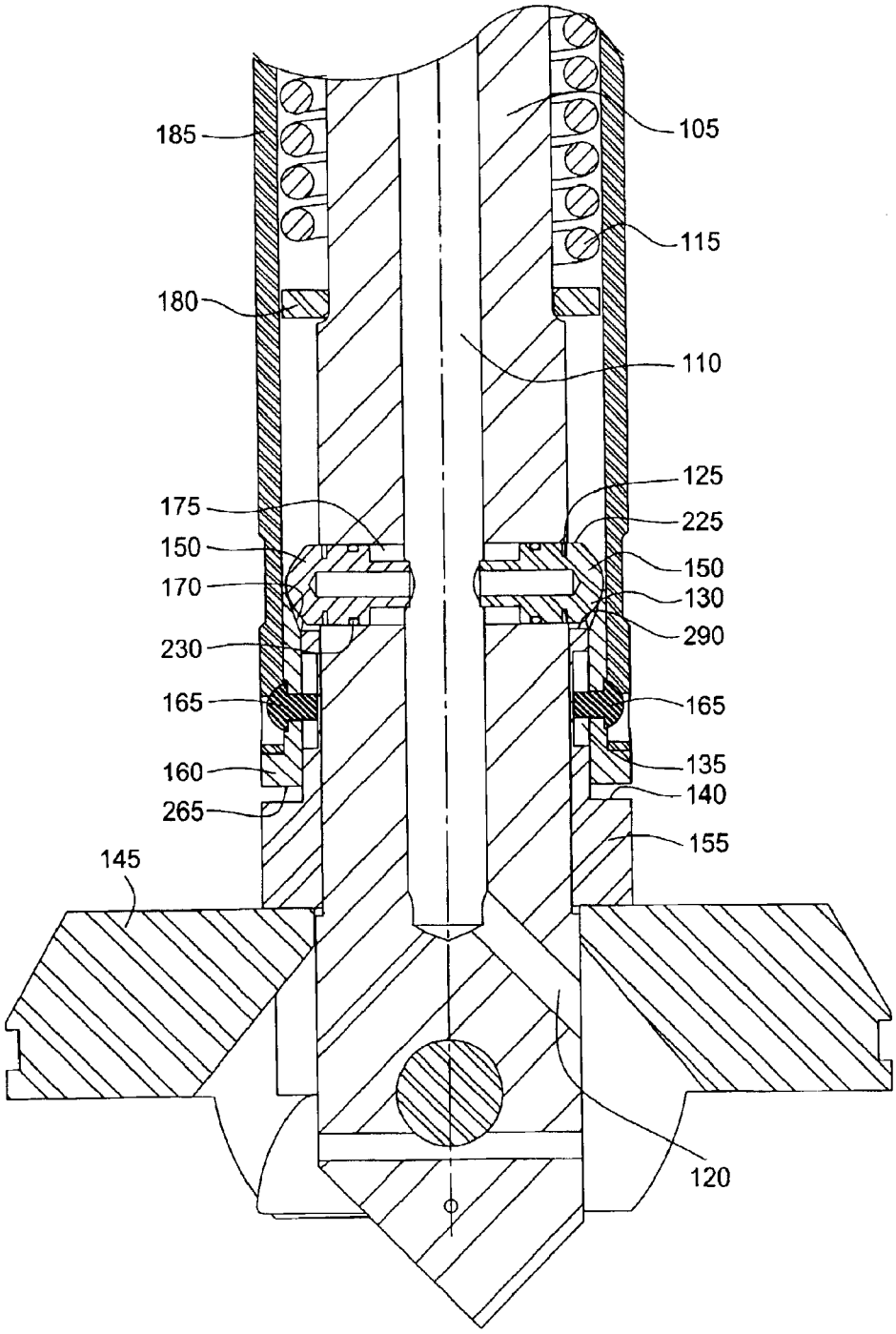
FIG. 3 illustrates the first stage in the unlocking sequence as the unlocking sleeve begins to urge the locking pins radially inward.

FIG. 3 illustrates the first stage in the unlocking sequence as the unlocking sleeve 160 begins to urge the locking pins 150 radially inward. After the downhole operation is complete, flow through the tool 100 is reduced, thereby causing the biasing member 115 to expand. As the biasing member 115 expands, the piston 185, pins 165 and the unlocking sleeve 160 are urged axially upward toward the sub (not shown). As the piston 185, pins 165 and the unlocking sleeve 160 move from the second position to the first position, the taper 170 on the unlocking sleeve 160 contacts the upper portion 130 of the locking pins 150, thereby urging the locking pins 150 radially inward toward the center bore 110. Additionally, the sleeve shoulder 265 loses contact with the cam shoulder 140, thereby allowing the cam 155 to begin releasing the blades 145.

Figure 4:
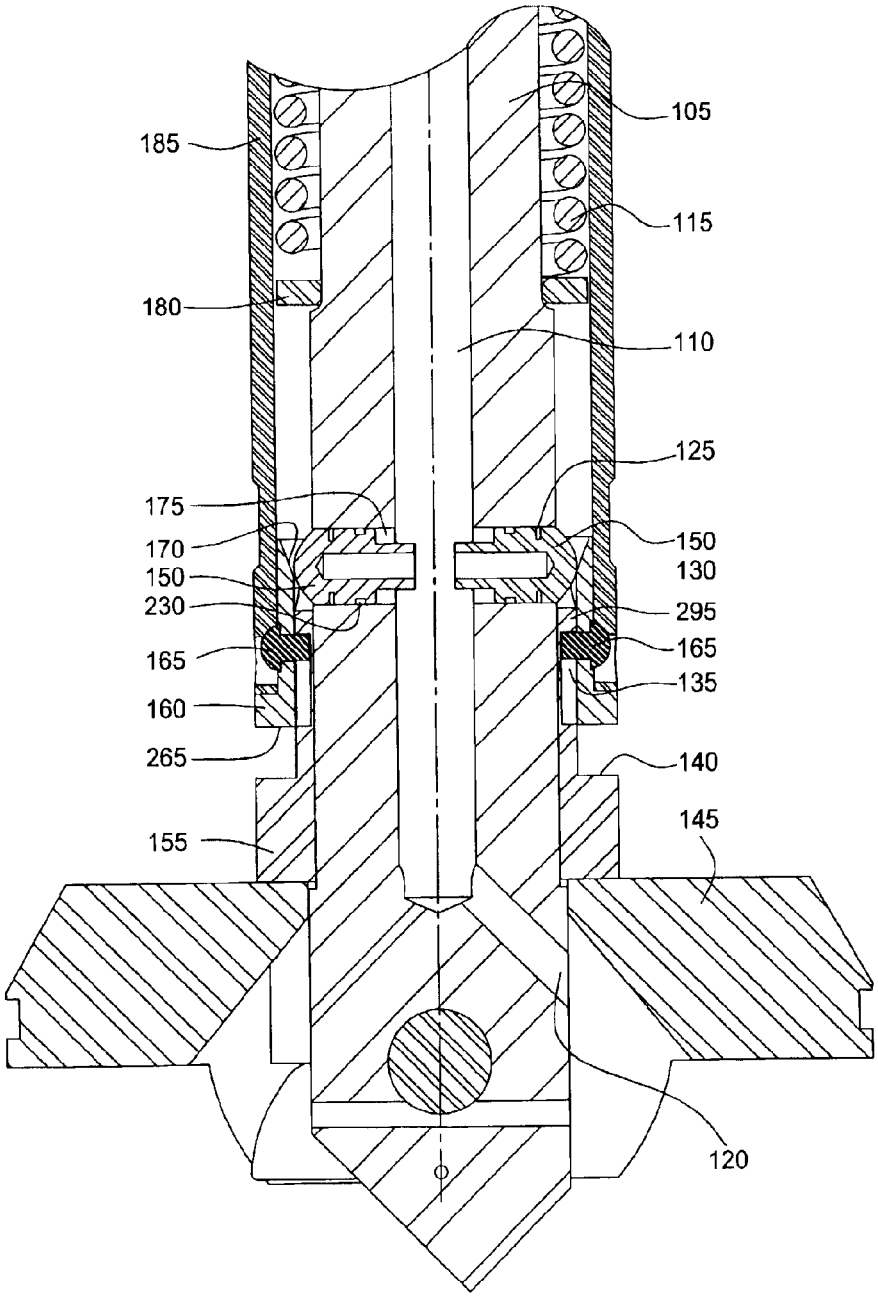
FIG. 4 illustrates the second stage of the unlocking sequence as the connection pins contact an end portion of the cam.

FIG. 4 illustrates the second stage of the unlocking sequence as the connection pins 165 contact an end portion 295 of the cam 155. As the piston 185, pins 165 and the unlocking sleeve 160 continue to move axially upward toward the sub (not shown), the connection pins 165 travel up slot 135 formed in the cam 155 until the pins 165 contact the end portion 295. At that point, the axial upper movement of the piston 185, pins 165 and unlocking sleeve 160 pulls the cam 155 away from the blades 145, thereby allowing the blades 145 to move from the open position toward the closed position. As further shown in FIG. 4, the locking pins 150 are urged further inward toward the central bore 110 as the unlocking sleeve 160 moves across the upper portion 130 of the locking pins 150. As the locking pins 150 restrict the flow through the center bore 110, a higher pressure is created in the tool 100. The higher pressure corresponds to a predetermined pressure, which indicates to the operator that the unlocking sequence is in the second stage.

Figure 5:
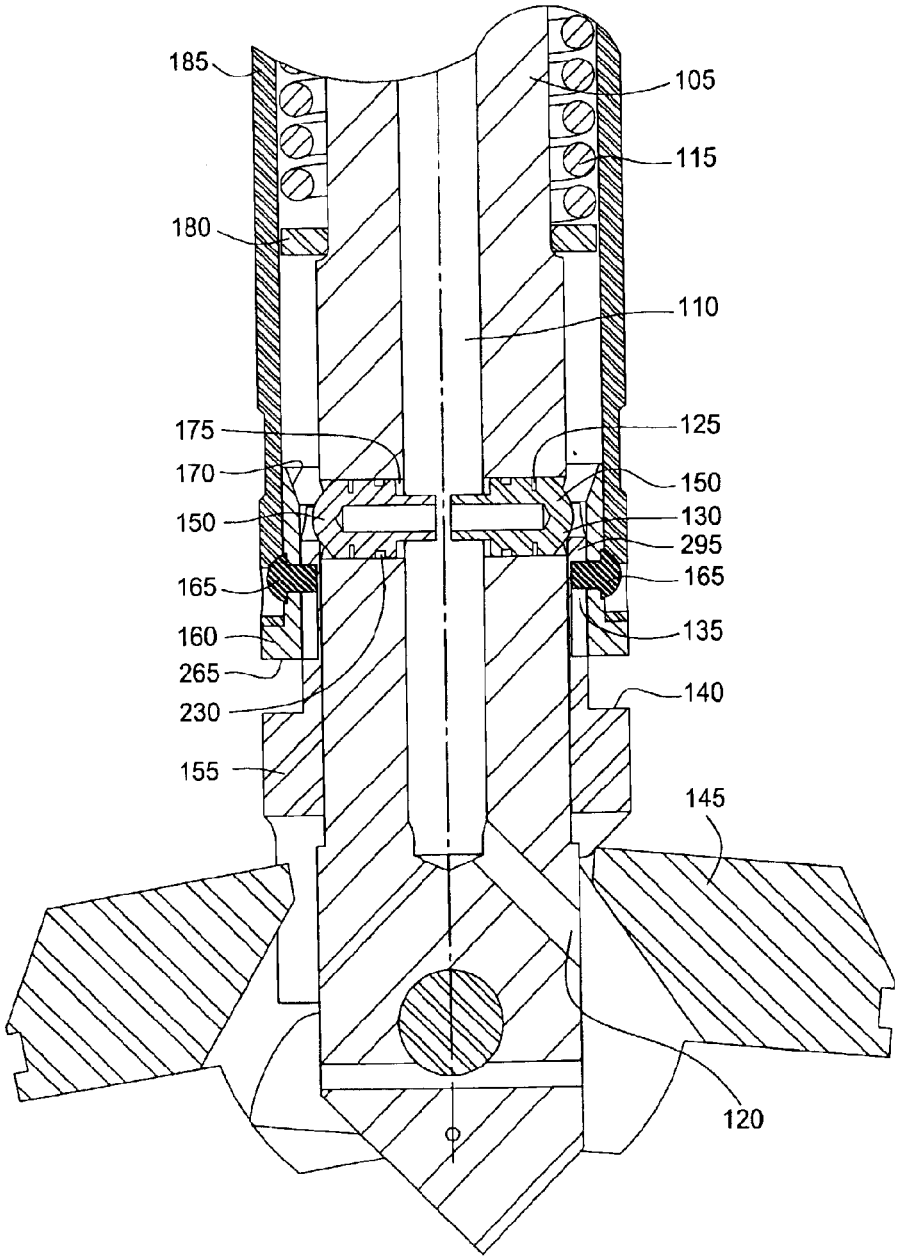
FIG. 5 illustrates the third stage of the unlocking sequence as the end portion of the cam contacts the upper portion of the locking pins.

FIG. 5 illustrates the third stage of the unlocking sequence as the end portion 165 of the cam 155 contacts the upper portion 130 of the locking pins 150. As shown, the cam 155 has moved axially upward allowing the end portion 165 to contact the upper portion 130 to further urge the locking pins 150 inward toward the center bore 110. As further shown, the blades 145 have started to retract inward to allow the tool 100 to be removed from the wellbore.

Figure 6A:
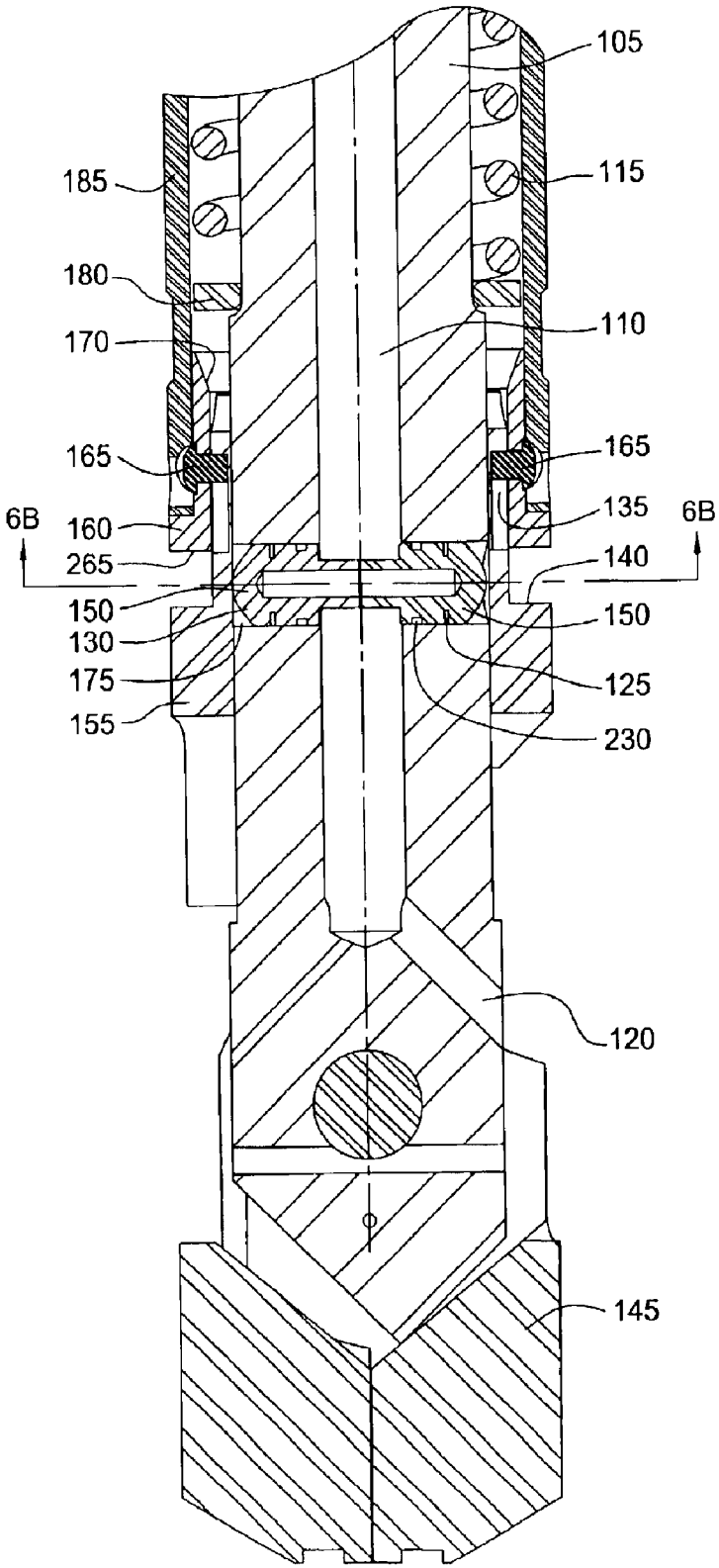
FIG. 6A is a cross-sectional view illustrating the tool unlocked and the blades in the closed position.
Figure 6B:
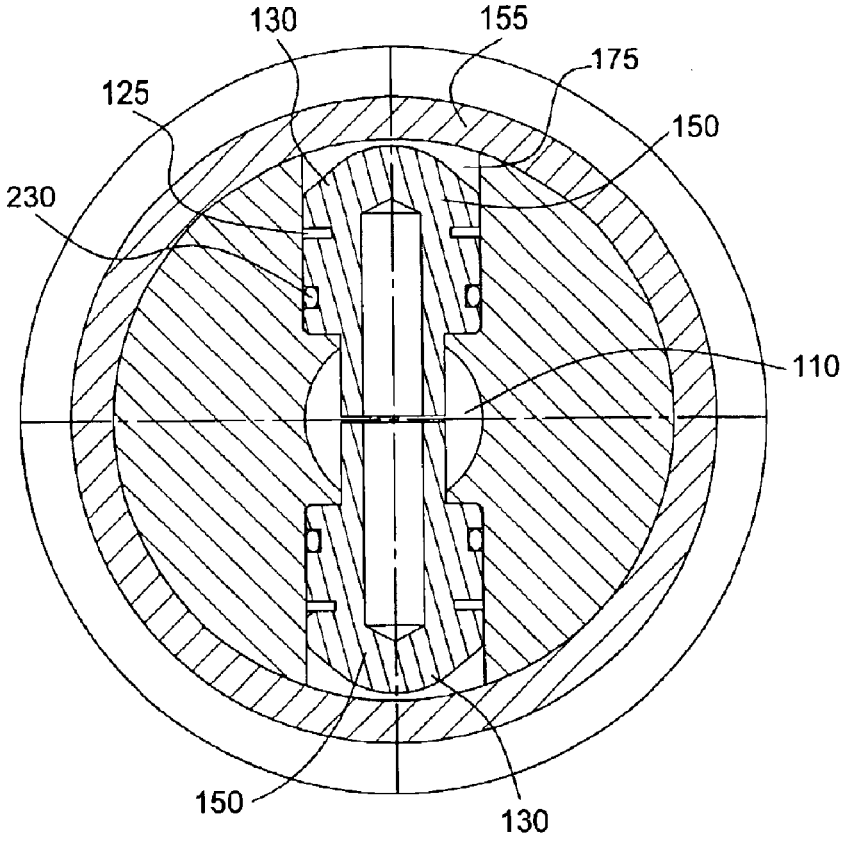
FIG. 6B is a cross-sectional view illustrating locking pins in a closed position.

FIG. 6A is a cross-sectional view illustrating the tool 100 unlocked and the blades 145 in the closed position. As shown, the tool 100 is in a deactivated state, the cam 155 has pushed the locking pins 150 to the closed position therefore ending the unlocking sequence. As further shown, biasing member 115 is uncompressed and the piston 185 is in the first position. Also shown, the blades 145 are completely closed allowing the tool 100 to be removed from the wellbore. FIG. 6B is a cross-sectional view illustrating locking pins 150 in a closed position. At this point, the operator may verify that the tool 100 is completely deactivated by pumping fluid through a tubular string (not shown) into the tool 100. As the fluid encounters the locking pins 150 in the closed position, a higher pressure is created in the tool 100. The higher pressure corresponds to a predetermined pressure, which indicates to the operator that the blades 145 are closed and the tool 100 is deactivated.

In operation, the tool is lowered on a tubular string to a predetermined location in the wellbore. Thereafter, fluid is pumped down the tubular string through the sub bore and enters the center bore. The fluid in the center bore is communicated to ports in the body and subsequently into cavities. The fluid pressure in the cavities urge the housing, the unlocking sleeve and the piston from the first position to the second position, thereby compressing a biasing member against a stop. At the same time, the sleeve shoulder acts against the cam shoulder to extend the blades to the open position.

The fluid pumped through the center bore also urges the locking pins radially outward towards the open position. In the open position, an upper portion of the locking pins project out from the body, thereby exposing a pin shoulder. The pin shoulder interacts with a cam surface to prevent axial movement of the cam. In this respect, the locking pins act as a lock to ensure the cam will not move axially, thereby allowing the blades to remain open throughout the operation of the tool.

After the downhole operation is complete, flow through the tool is reduced causing the biasing member to expand and begin the first stage of the unlocking sequence. As the biasing member expands, the piston, connection pins and the unlocking sleeve are urged axially upward toward the sub. As the piston, connection pins and the unlocking sleeve move from the second position to the first position, the taper on the unlocking sleeve interacts with the upper portion of the locking pins, thereby urging the locking pins radially inward toward the center bore. Additionally, the sleeve shoulder loses contact with the cam shoulder, thereby allowing the cam to begin the release of the blades.

In the second stage of the unlocking sequence, the connection pins contact an end portion of the cam. As the piston, connection pins and the unlocking sleeve continue to move axially upward toward the sub, the connection pins travel up slot formed in the cam until the connection pins contact the end portion of the slot. At that point, the axial upper movement of the piston, connection pins and unlocking sleeve pulls the cam away from the blades, thereby allowing the blades to move from the open position toward the closed position. Additionally, the locking pins are urged further inward toward the central bore as the unlocking sleeve moves across the upper portion of the locking pins. As the locking pins restrict the flow through the center bore, a higher pressure is created in the tool. The higher pressure corresponds to a predetermined pressure, which indicates to the operator that the unlocking sequence is in the second stage. In the third stage of the unlocking sequence, the end portion of the cam contacts the upper portion of the locking pins to further urge the locking pins inward toward the center bore.

After the unlocking sequence is complete, the blades are closed and the locking pins are in the closed position. At this point, the operator may verify that the tool is completely deactivated by pumping fluid through a tubular string into the tool. As the fluid encounters the locking pins in the closed position, a higher pressure is created in the tool. The higher pressure corresponds to a predetermined pressure, which indicates to the operator that the blades are closed and the tool is deactivated. Thereafter, the tool may be removed from the wellbore.

While the foregoing is directed to embodiments of the present invention, other and further embodiments of the invention may be devised without departing from the basic scope thereof, and the scope thereof is determined by the claims that follow.

What is claimed is:

1. A method of operating a locking mechanism for a downhole tool, the method comprising:

running the tool and the locking mechanism into a wellbore, the tool disposed on a string of tubulars;

flowing a fluid through the tubular string and a bore of the tool;

causing the fluid, at a predetermined flow rate, to move a sleeve from an unlocked to a locked position; and causing a retention assembly, to retain the sleeve in the locked position.

2. The method of claim 1, further including the step of producing a signal, receivable at the surface or the well, the signal communicating a position of the sleeve.

3. A reaming device for use in a wellbore comprising:

a body with a central bore therethrough, the body attachable to a string of tubulars;

a set of cutting members radially extendable from the body; and a fluid actuated locking mechanism for the cutting members consisting of:

a piston annularly disposed about the body, the piston having a piston surface in fluid communication with the central bore at a first end of the piston in the actuated position, locking the cutting members in an extended position; and at least one pin retaining the piston in the activated position when a predetermined amount of fluid is passed through the body.

4. An apparatus for use in a wellbore comprising:

a mandrel having a center bore and at least one side bore in communication with the center bore;

a mechanical portion moveable between an open position and a closed position;

a sliding member movable between a first and a second position;

a biasing member disposed on the mandrel; and at least one pin disposed in the at least one side bore, the at least one pin is moveable between a open position and a closed position, whereby in the closed position the at least one pin restricts fluid flow through the center bore and in the open position the at least one pin locks the mechanical portion in the open position.

5. A method for operating a downhole tool in a wellbore, comprising:

inserting the downhole tool into the wellbore, the downhole tool having:

a mandrel having a center bore and at least one side bore in communication with the center bore;

a mechanical portion moveable between an open position and a closed position;

a sliding member movable between a first and a second position;

a biasing member disposed on the mandrel; and at least one pin disposed in the at least one side bore, the at least one pin is moveable between an open position and a closed position;

pumping fluid through the center bore to move the mechanical portion from the closed position to the open position;

moving the at least one pin from the closed position to the open position to lock the mechanical portion in the open position; and indicating the mechanical portion is open and locked.

6. A reaming device for use in a wellbore comprising:

a body with a fluid flow path therethrough, the body attachable to a string of tubulars;

a cutting member extendable from the body radially; and a fluid actuated locking mechanism for the cutting member, the locking mechanism having at least two radially extendable members constructed and arranged to retain a piston adjacent the cutting member while in an extended position.

7. The reaming device of claim 6, whereby the device is movable in either of two axial directions.

8. A locking mechanism for a downhole tool comprising:

an annular, two position sleeve having an unlocked position and a locked position; and a retention assembly constructed arid arranged to retain the sleeve in the locked position, wherein the locking mechanism is fluid actuated and is operated by the flow of a fluid through a bore in the tool.

9. The locking mechanism of claim 8, wherein the sleeve includes a piston surface in fluid communication with the bore, the sleeve movable from the unlocked to the locked position with the application of the fluid on the piston surface.

10. The locking mechanism of claim 9, wherein the sleeve is biased in the unlocked position.

11. The locking mechanism of claim 10, wherein the retention assembly includes pins that are extendable radially outward to interfere with the sleeve, thereby retaining the sleeve in the locked position.

12. The locking mechanism of claim 10, wherein the tool is a cutting tool with extendable cutters and the locking mechanism operates to hold the cutters in an extended position against a force.

13. The locking mechanism of claim 11, wherein the extendable pins provide a restriction in the born of the tool when the pins are in a retracted position and a lesser restriction when the pins are in an extended position.

14. The locking mechanism of claim 13, wherein the restriction in the bore of the tool is usable to indicate the position of the pins based upon a back-pressure that is developed as fluid flow through the tool.

15. An apparatus for use in a wellbore comprising:

a body with a central bore therethrough;

a set of cutting members radially extendable from the body; and a locking mechanism in fluid communication with the central bore, the locking mechanism having a movable piston for locking the cutting members in an extended position and at least one fluid actuated pin for retaining the piston adjacent the cutting members while in the extended position.

16. A locking mechanism for a downhole tool comprising:

an annular, two position sleeve having an unlocked position and a locked position; and a retention assembly having at least two radially extendable members constructed and arranged to retain the sleeve in the locked position, wherein the radially extendable members are fluid actuated.

* * * * *